United States Patent [19]

Leckband et al.

[11] 4,390,029

[45] Jun. 28, 1983

[54] APPARATUS FOR STORING AND TRANSPORTING COMMINUTED TOBACCO OR THE LIKE

[75] Inventors: Uwe Leckband, Hamburg; Willi Thiele; Klaus Hagenah, both of Geesthacht; Hans Förster, Hamburg, all of Fed. Rep. of Germany

[73] Assignee: Hauni-Werke Körber & Co. KG, Hamburg, Fed. Rep. of Germany

[21] Appl. No.: 130,620

[22] Filed: Mar. 17, 1980

Related U.S. Application Data

[63] Continuation-in-part of Ser. No. 125,230, Feb. 27, 1980, abandoned.

[51] Int. Cl.[3] ..... A24C 5/02

[52] U.S. Cl. ..... 131/109 AB; 131/110; 131/108; 131/909

[58] Field of Search ..... 131/909, 280, 108, 109, 131/109 R, 110, 109 AB, 108 R; 406/89, 91, 85, 95, 138, 142; 198/766

[56] References Cited

U.S. PATENT DOCUMENTS

| | | | |
|---|---|---|---|
| 2,968,232 | 1/1961 | Carvallo | 198/766 |
| 3,062,414 | 11/1962 | Morris | 406/89 |
| 3,099,492 | 7/1963 | Mortimer | 131/909 |
| 3,260,389 | 7/1966 | Paton | 406/95 |
| 3,351,391 | 11/1967 | Green | 406/138 |
| 3,830,548 | 8/1974 | Sem | 406/85 |
| 3,861,753 | 1/1975 | Lesk et al. | 406/85 |
| 3,881,498 | 5/1975 | Wochnowski | 131/302 |
| 4,155,367 | 5/1979 | Rudszinat | 131/110 |

FOREIGN PATENT DOCUMENTS

| | | | |
|---|---|---|---|
| 685219 | 4/1964 | Canada | 406/75 |
| 2159182 | 6/1973 | France | 406/142 |
| 39147 | 1/1974 | U.S.S.R. | 406/138 |
| 609698 | 6/1978 | U.S.S.R. | 406/138 |

*Primary Examiner*—V. Millin

*Attorney, Agent, or Firm*—Kontler, Grimes & Battersby

[57] ABSTRACT

Shredded tobacco is supplied from a storage reservoir to one or more cigarette making machines by way of discrete pneumatic conveying pipes. The reservoir receives fresh tobacco at regular or irregular intervals so that the quantity of tobacco in its interior is constant. The contents of the reservoir are maintained in suspension so that at least the major part of the supply of tobacco shreds forms a fluidized bed which is located directly below the intakes of the conveying pipes. When a machine requires a batch of tobacco shreds, the respective pipe is connected to a suction generating device so that it draws air from the region between the underside of the fluidized bed and the upper side of the bottom wall of the reservoir whereby the ascending current of air entrains tobacco particles directly from the fluidized bed. The supply of tobacco in the reservoir can be converted into a fluidized bed by mechanically agitating the reservoir so that the shreds move up and down and/or by causing a plurality of streamlets of compressed air to rise through perforations in the bottom wall of the reservoir. The latter may have a circular, semicircular or polygonal cross-sectional outline.

42 Claims, 14 Drawing Figures

Fig.2
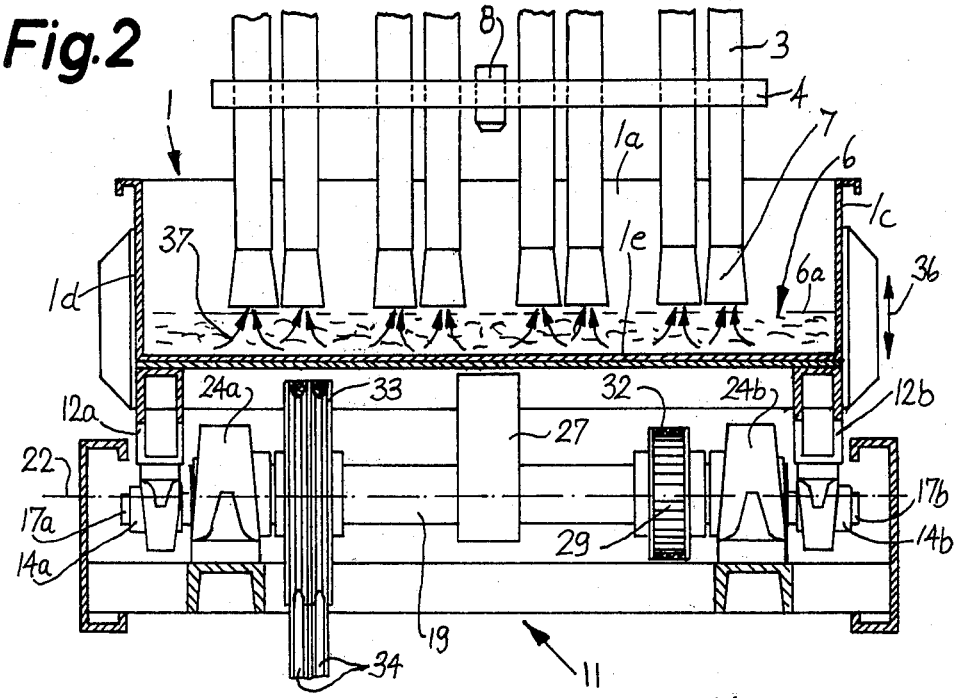
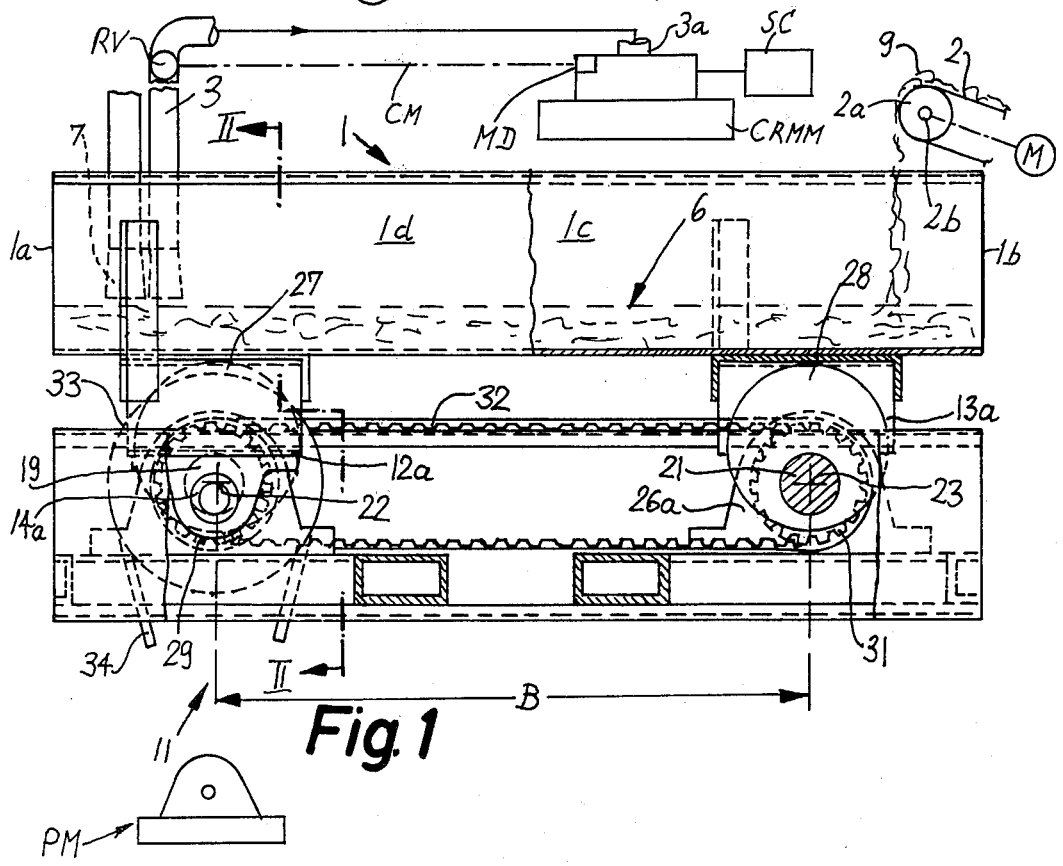
Fig.1

Fig. 3
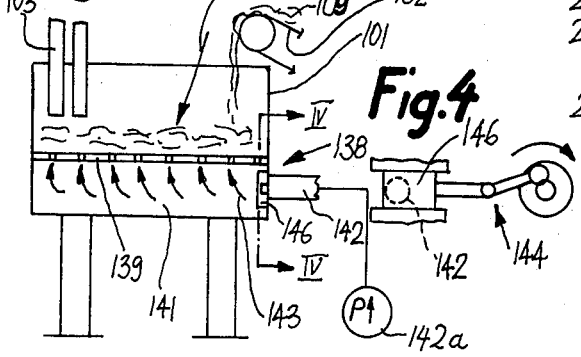
Fig. 4
Fig. 5
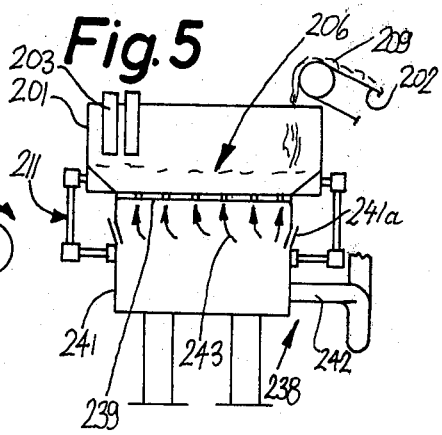
Fig. 6
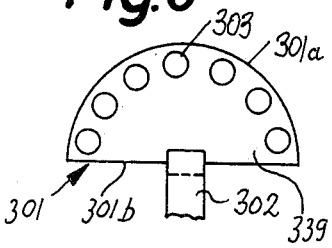
Fig. 7
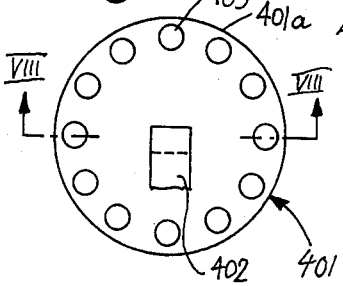
Fig. 8
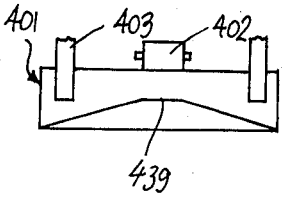
Fig. 9
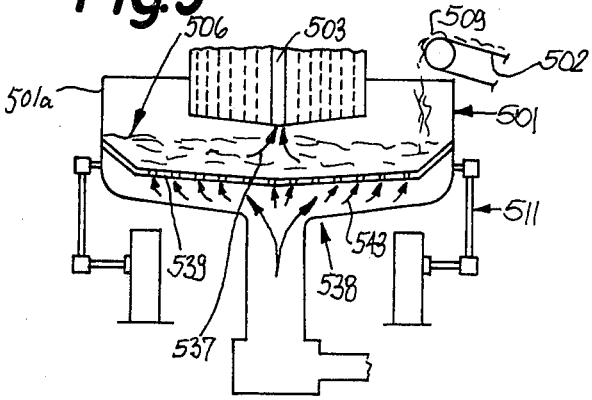

APPARATUS FOR STORING AND TRANSPORTING COMMINUTED TOBACCO OR THE LIKE

CROSS-REFERENCE TO RELATED APPLICATION

This is a continuation-in-part of our copending application Ser. No. 125,230 filed Feb. 27, 1980 for "Method and apparatus for storing and transporting comminuted tobacco or the like", now abandoned.

BACKGROUND OF THE INVENTION

The present invention relate to apparatus for storing and transporting fibrous material, and more particularly to apparatus for storing and transporting comminuted tobacco. Still more particularly, the invention relates to storage of tobacco shreds and/or otherwise configurated tobacco particles, and to pneumatic transfer of metered or randomly selected quantities of such particles from the locus of storage to two or more consuming stations, e.g., to the hoppers of several discrete cigarette rod making machines.

It is already known to accumulate a supply of tobacco particles in a storage reservoir and to transfer particles of tobacco from the reservoir to one or more consuming machines by way of discrete pneumatic conveyors in the form of pipes. A drawback of presently known apparatus of the just outlined character is that the pipes are likely to be clogged by accumulations of interlaced tobacco shreds and also that the consistency of the supply of tobacco particles in the reservoir is not uniform. This presents problems in connection with metering of the quantities of tobacco particles which are to be delivered to selected consuming machines. Moreover, the quality of products which are turned out by several machines is not uniform.

OBJECTS AND SUMMARY OF THE INVENTION

An object of the invention is to provide a novel and improved delivering comminuted tobacco or like particulate material to two or more discrete consuming or processing machines, either seriatim, at random or simultaneously, especially for delivering tobacco shreds to discrete tobacco (e.g., cigarette) rod making machines.

Another object of the invention is to provide apparatus for of the just outlined character which controlled simultaneous delivery of comminuted fibrous material to a relatively small or a relatively large number of discrete consuming machines.

A further object of the invention is to provide an apparatus for which ensures adequate delivery of comminuted fibrous material to one or more consuming stations without undue damage to the conveyed material, especially without pronounced comminution of tobacco shreds.

An additional object of the invention is to provide an apparatus for storage and delivery of comminuted fibrous material to one or more consuming machines, such as a battery of cigarette rod making machines which require batches of shredded tobacco at regular or irregular intervals.

Another object of the invention is to provide an apparatus of the just outlined character which treats the stored and transported material gently, which can rapidly transport large quantities of particulate material to one or more selected destinations, which can convey the material along paths of desired configuration so as to conform such paths to the space which is available between the storing area and the consuming machines, and which occupies a relatively small amount of space even though it can satisfy the requirements of a large number of consuming machines.

A further object of the invention is to provide an apparatus which is especially suited for storage and distribution of shredded tobacco in such a way that the shreds do not yield large quantities of short tobacco and/or tobacco dust.

One feature of the invention resides in the provision of an apparatus for supplying fibrous material, especially comminuted tobacco (such as tobacco shreds) to several consuming machines (e.g., to a battery of cigarette rod making machine). The apparatus comprises means for accumulating a supply of comminuted tobacco means for, converting at least the major part of the supply into a fluidized bed of floating tobacco, means for establishing discrete paths between the supply and means for the consuming machines, and pneumatically conveying comminuted tobacco directly from the fluidized bed to a selected consuming machine or to two or more selected consuming machines whenever the need arises.

The apparatus may further comprise means for admitting or feeding comminuted tobacco to the supply so as to maintain the quantity of comminuted tobacco in the fluidized bed at a substantially constant value. The conveying means may comprise means for transporting comminuted tobacco by suction.

At least some of the paths (such paths can be defined by pneumatic conveying pipes) can have tobacco receiving portions which extend substantially vertically from the fluidized bed, preferably vertically upwardly.

The converting means may comprise means for imparting to the tobacco of the supply a recurrent up-and-down movement, e.g., by mechanically agitating the ingredients of the supply.

Alternatively, the converting means may comprise means for subjecting comminuted tobacco of the supply to the lifting action of ascending currents of a gaseous fluid, preferably compressed air. The ascending currents of compressed air or another gas can be pulsated to achieve an even more satisfactory fluidizing action.

Still further, the converting means may comprise means for mechanically agitating the tobacco particles of the supply and for simultaneously subjecting the particles to the lifting action of ascending currents of compressed air or another gaseous fluid.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 1 is a partly elevational and partly longitudinal vertical sectional view of an apparatus which embodies one form of the invention and has a polygonal storage reservoir for comminuted tobacco;

FIG. 2 is a transverse vertical sectional view as seen in the direction of arrows from the line II—II of FIG. 1;

FIG. 3 is a schematic partly elevational and partly longitudinal vertical sectional view of a second apparatus wherein the particles in the interior of the reservoir are converted into a fluidized bed by several streamlets of a compressed gaseous fluid;

FIG. 4 is a schematic sectional view as seen in the direction of arrows from the line IV—IV of FIG. 3;

FIG. 5 is a schematic partly elevational and partly vertical sectional view of a third apparatus wherein the tobacco is converted into a fluidized bed by resorting to pneumatic as well as mechanical converting means;

FIG. 6 is a schematic plan view of a substantially semicylindrical storage reservoir as well as of a portion of means for feeding tobacco particles into and for drawing tobacco from the reservoir;

FIG. 7 is a schematic plan view of a substantially cylindrical storage reservoir with a feeding means which discharges comminuted tobacco into the central portion of the reservoir;

FIG. 8 is a sectional view as seen in the direction of arrows from the line VIII—VIII of FIG. 7;

FIG. 9 is a schematic partly elevational and partly vertical sectional view of an apparatus wherein the intake ends of conveying pipes which transport comminuted tobacco to discrete consuming machines are diposed in the central portion of the storage reservoir;

DESCRIPTION OF THE PREFERRED EMBODIMENTS

Figure 10:
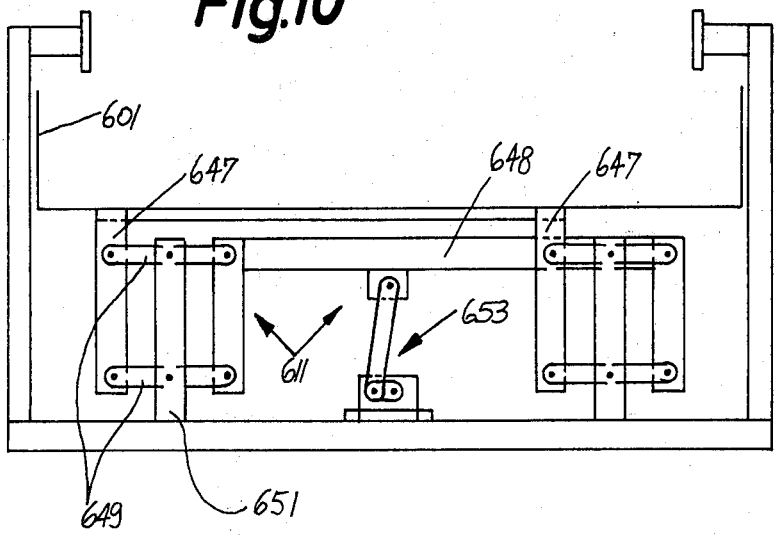
FIG. 10 is a schematic partly side elevational and partly vertical sectional view of an apparatus wherein the storage reservoir is agitated by a drive which constitutes a modification of the drive for the reservoir shown in FIGS. 1 and 2.

The apparatus which is shown in FIGS. 1 and 2 serves to transport batches of comminuted tobacco, preferably tobacco shreds 9, to sixteen discrete consuming or processing machines, e.g., to cigarette rod making machines CRMM of the type known as GARANT manufactured by the assignee of the present application. Each cigarette rod making machine has a hopper H for a supply of tobacco shreds, and such hopper can receive a batch (preferably a metered quantity) of tobacco shreds by way of one of sixteen discrete pneumatic conveying pipes 3, one for each machine CRMM.

The apparatus comprises a magazine or storage reservoir 1 (e.g., a trough) which has a rectangular cross-sectional outline and receives tobacco shreds 9 from a larger source of supply (not shown) by way of one or more tobacco feeding devices. FIG. 1 shows a single feeding device including an endless belt or band conveyor 2 which is trained over pulleys 2*a* (only one shown) and whose discharge end serves to deliver tobacco shreds 9 into the right-hand end portion of the reservoir 1, as viewed in FIG. 1. The delivery of shreds 9 into the reservoir 1 preferably takes place intermittently, normally (but not necessarily) at irregular intervals, so as to ensure that the quantity of tobacco shreds 9 in the reservoir is at least substantially constant irrespective of whether the reservoir supplies tobacco shreds 9 to a single machine CRMM, simultaneously to two discrete machines, or simultaneously to three or more discrete machines. Also, the machines CRMM can receive tobacco shreds 9 in a given sequence or at random, depending on the quantity of tobacco shreds in the hoppers H of the respective machines. FIG. 1 shows a regulating valve RV in one of the pneumatic conveyor pipes 3; such valve is connected with a suitable monitoring device MD in the hopper H of the respective machine CRMM by conductor means CM so as to open the valve RV and to thus connect the discharge end 3*a* of the respective pipe 3 to a pressure reducing means in the form of a suction chamber SC whenever the upper surface or side of the supply of tobacco shreds 9 in the hopper H descends to a preselected lowermost permissible level. The aforedescribed components of the means for opening and closing the regulating valve RV are commercially available parts whose design forms no part of the present invention.

The upper side of the supply 6 of tobacco shreds 9 in the storage reservoir 1 is monitored by a detector in the form of a reflection type photocell 8 which is installed in or on a stationary carrier 4 at a level above the open upper side of the reservoir. The photocell 8 generates a signal when the supply of tobacco shreds 9 in the reservoir 1 is depleted to a predetermined extent whereby the signal initiates the starting of a motor M for the shaft 2*b* of the pulley 2*a* so that the conveyor 2 is set in motion and begins to replenish the supply 6. The carrier 4 further supports some or all of the sixteen pneumatic conveying pipes 3, preferably in such a way that each pipe can be readily detached therefrom and/or adjusted in the lengthwise direction thereof. FIGS. 1 and 2 show that the pipes 3 form two rows of eight pipes each and that these rows are adjacent to the left-hand end wall 1*a* of the reservoir 1, as viewed in FIG. 1, i.e., to that end wall which is remote from and is located opposite the discharge end of the conveyor 2. Each row of pipes 3 consists of four pairs of pipes, and each such pair of pipes is aligned with a pair of pipes of the other row so that the pipes 3 form four groups of four pipes each. The two rows of pipes 3 are parallel to each other and to the end walls 1*a* and 1*b* of the storage reservoir 1.

In accordance with a feature of the invention, the supply 6 of tobacco shreds 9 in the storage reservoir 1 constitutes a so-called fluidized bed (also called jet bed) consisting of floating particles which form a layer extending all the way from the end wall 1*a* to the end wall 1*b* and all the way between the two side walls 1*c*, 1*d* of the reservoir 1. Since the upper side of the supply of tobacco shreds 9 (i.e., the upper surface of the fluidized bed 6) is monitored by the photocell 8 which intermittently starts and arrests the conveyor 2, the upper side of the bed 6 is normally located at a practically fixed distance from the bottom wall or plate 1*e* of the reservoir 1. Such upper side (indicated at 6*a*) is closely adjacent to the open lower ends of the hollow frustoconical intakes or lower end portions 7 of the pipes 3. Each intake 7 tapers upwardly, i.e., in the direction of flow of tobacco shreds 9 from the interior of the reservoir 1 toward the respective machine CRMM. It will be noted that at least the lower parts of the pipes 3 (including the intakes 7) are vertical or nearly vertical so that the suction chamber SC which happens to communicate with a selected pipe 3 must draw the particles 9 from the bed 6 and in an upward direction (away from the bottom wall 1*e* of the reservoir 1).

The means for converting the supply of tobacco shreds 9 into the fluidized bed 6 comprises a mechanical drive 11 which agitates the storage reservoir 1 so that the shreds 9 are moved substantially up and down, i.e., they are propelled upwardly and away from the bottom wall 1*e* during certain stages of each recurrent movement of the storage reservoir. The drive 11 oscillates the reservoir 1 at a selected frequency. As will be described below, the drive 11 is designed to move the bottom wall 1*e* substantially up and down with attendant automatic conversion of tobacco shreds 9 in the interior of the reservoir 1 into a uniform fluidized bed 6 which overlies the entire bottom wall 1*e* and has a constant or at least nearly constant height.

The drive 11 of the converting means is constructed as follows:

The bottom wall 1*e* of the reservoir 1 is mounted on four discrete profiled holders which are disposed at or close to the four corners of the reservoir. FIGS. 1 and 2 show three of these holders (12*a*, 12*b* in FIG. 2 and 13*a* in FIG. 1). The distance between the centers of the holders 12*a*, 13*a* is shown at B. The center of the holder 12*b* is disposed at the same distance from the fourth holder which is not shown in the drawing. Each holder is connected with a carrier for a discrete bearing. Two of these carriers are shown in FIGS. 1 and 2, as at 14*a* and 14*b*. Each carrier supports a rotary eccentric; the eccentrics which are mounted in the carriers 14*a*, 14*b* are respectively shown at 17*a*, 17*b*. The eccentrics 17*a*, 17*b* are mounted on a first shaft 19, and the other two eccentrics (which are not illustrated in FIGS. 1 and 2) are mounted on a shaft 21 which is parallel with the shaft 19. The axes of the shafts 19 and 21 are respectively shown at 22 and 23. Since the eccentrics are fixed to the respective shafts 19 and 21, they perform orbital movements along circular paths extending about the corresponding axes 22 and 23. Thus, when the shafts 19 and 21 are driven, the eccentrics (including those shown at 17*a*, 17*b*) move the receptacle 1 up and down via holders 12, 13 (see particularly FIG. 2) at four spaced locations which are respectively adjacent to the four corners of the bottom wall 1*e*.

The shafts 19 and 21 are journalled in suitable bearings which include two bearings 24*a*, 24*b* for the shaft 19 and two bearings (including the bearing 26*a*) for the shaft 21. These shafts respectively carry counterweights 27 and 28 in the form of eccentrically mounted discs or wheels serving to balance the forces which are generated in response to rotation of the aforediscussed eccentrics.

The means for driving the shaft 21 comprises coplanar gears or toothed pulleys 29, 31 which are respectively fixed to the shafts 19, 21 and a toothed belt 32 which is trained over the members 29, 31. The shaft 19 receives torque from a prime mover PM (e.g., a variable-speed electric motor) which drives a series of endless V-belts 34 trained over a pulley (not shown) on the output element of the prime mover PM and over a pulley 33 on the shaft 19. The parts 34, 33, 32, 31 and 29 synchronize the movements of the eccentrics 17*a*, 17*b* with the movements of the other two eccentrics so that the angular positions of the eccentrics on the shaft 21 are always identical with the angular positions of the eccentrics 17*a*, 17*b* on the shaft 19.

The operation of the drive 11 for the storage reservoir 1 is as follows:

When the prime mover PM is on, it rotates the shaft 19 via V-belts 34 and pulley 33, and the shaft 19 rotates the shaft 21 via toothed belt 32 and gears or pulleys 29, 31. The four eccentrics including the eccentrics 17*a*, 17*b* perform synchronous orbital movements about the respective axes 22, 23. Consequently, the eccentrics move the bottom wall 1*e* of the storage reservoir 1 up and down. More particularly, the path of the reservoir 1 is an endless circular path. Since the speed of the prime mover PM is variable, the frequency at which the reservoir 1 is oscillated can be readily selected in such a way that the shreds 9 in the interior of the reservoir are accelerated and propelled vertically upwardly so that at least the major percentage of the shreds 9 invariably forms the aforediscussed fluidized bed 6. Thus, the major percentage of shreds 9 forms a layer of separate or practically separate tobacco particles which are spaced apart from the upper side of the bottom wall 1*e*. The exact RPM of the output element of the prime mover PM can be readily selected in such a way that it ensures the conversion of the entire or nearly entire supply of tobacco shreds 9 into a fluidized bed or layer. The just mentioned selected RPM depends on a number of parameters, some of which are characteristic of the design of the apparatus and some of which are characteristic of the nature of agitated material in the storage reservoir 1.

The arrow 36 (shown in the right-hand portion of FIG. 2) indicates the directions of up-and-down movement of the shreds 9 in the interior of the storage reservoir 1. Such movement of tobacco shreds 9 renders it possible to establish the upper side 6*a* of the bed 6 at a level immediately or closely below the open lower ends of the intakes 7. Whenever the regulating valve RV in a selected conveying pipe 3 is opened in response to a signal from the associated monitoring device MD in the hopper H of the selected machine CRMM, the intake 7 of such pipe 3 sucks loosened and uniformly distributed and thoroughly and uniformly intermixed shreds 9 directly from the bed 6. In other words, the selected intake 7 draws a current 37 of air by suction from the zone below the bed 6, i.e., from the space immediately above the upper side of the bottom wall 1*e*. Such current 37 entrains tobacco shreds 9 from the bed 6 and conveys them into the corresponding hopper H. It can be readily seen that when the apparatus of FIGS. 1 and 2 is in use and that, as a pipe 3 draws a stream of tobacco shreds 9 upwardly, the shreds 9 which form part of other portions of the bed 6 migrate toward the lower end of the activated pipe 3 so as to ensure that the uniformity of thickness of the bed 6 is restored practically instantaneously. The same holds true if two or more pipes 3 draw tobacco shreds 6 at one and the same time, or if the withdrawal of tobacco shreds 9 by way of a first pipe 3 coincides only in part with withdrawal of tobacco shreds by way of one or more additional pipes 3. The just discussed migration of tobacco shreds 9 toward the loci of withdrawal of shreds from the bed 6 insures thorough intermixing of tobacco shreds in the bed 6 so that the latter contains a uniform mixture of longest, medium long and shorter shreds. This is highly desirable because each of the sixteen cigarette rod making machines CRMM invariably receives the same type of mixture so that the quality of cigarettes which are produced in these machines is the same or does not vary from machine to machine on the ground that the hopper or hoppers H of one machine or a certain group of machines CRMM contain a mixture which is different from the mixture in the other hopper or hoppers.

The reflection type photocell 8 generates a signal to start the motor M for the shaft 2b of the pulley 2a whenever the upper side 6a of the fluidized bed 6 descends below a preselected level. This, too, contributes to uniformity of the mixture which forms the bed 6 and thus contributes to uniformity of the quality of final products. Tobacco shreds 9 which are delivered by the conveyor 2 are immediately caused to share the up-and-down movements of the previously supplied shreds 9 to thus ensure that at least the major percentage of the supply of shreds in the storage reservoir 1 forms part of the fluidized bed 6. When the upper side 6a of the bed 6 rises to the preselected level, the signal from the photocell 8 disappears or is modified so as to arrest the motor M.

The drive 11 of FIGS. 1 and 2 has been found to invariably convert the freshly admitted tobacco shreds 9 as well as the basic supply of such shreds in the interior of the storage reservoir 1 into a highly satisfactory fluidized bed which contains a uniform mixture of shreds and whose constituents can enter one or more selected conveying pipes 3 even if the speed of the current or currents of air in such pipe or pipes is relatively low. This is due to the fact that the aforedescribed eccentrics (including the eccentrics 17a and 17b) cause the shreds 9 in the storage reservoir 1 to move up and down. i.e., vibratory movements of the reservoir 1 are such that the particles therein are propelled upwardly and thereupon descend before being propelled again with attendant formation of a fluidized bed having a desired uniform thickness and consisting of uniformly distributed and intermixed particles. Such substantially vertical movements of the particles, with no stray movement or with negligible stray movement in other directions, can be readily achieved in response to driving the shafts 19 and 21 at a given RPM. It goes without saying that the storage reservoir 1 can be replaced with a magazine having a square or other polygonal cross-sectional outline.

The designer of the improved apparatus has substantial freedom of selecting the positions of intakes 7 with reference to the walls of the reservoir 1 as well as with reference to the locus of the discharge end of the conveyor 2. This is due to the fact that the thickness or height of the fluidized bed 6 is uniform or nearly uniform in all zones of the reservoir 1 as well as that the bed 6 consists of a homogeneous mixture of tobacco shreds 9. Nevertheless, it is normally preferred to place the intakes 7 at a certain distance from the discharge end of the conveyor 2, e.g., to position these components in a manner as shown in FIGS. 1 and 2 so that the intakes 7 are adjacent to one end wall 1a and the discharge end of the conveyor 2 is adjacent to the other end wall 1b of the reservoir 1.

In the apparatus of FIGS. 1 and 2, the reservoir 1 is directly connected with the holders 12, 13 which, in turn, rest directly on the eccentrics including the eccentrics 17a, 17b. In other words, and since the parts 12, 13 can be said to constitute components of the reservoir 1, the latter is mounted directly on the eccentrics.

By way of example, the storage reservoir 1 of FIGS. 1 and 2 can have a length of 1400 mm and a width of 1000 mm. The minimum height of the apparatus can be approximately 800 mm and the diameters of the pipes 3 can be somewhere between 90 and 125 mm. The power requirements of such apparatus are approximately 0.7 kW per hour. The open ends of the intakes 7 of conveying pipes 3 can be located at a distance of approximately 95 mm above the bottom wall 1e.

The customary air locks which are provided at or close to the discharge ends 3a of the pipes 3 to segregate the entrained tobacco shreds 9 from the gaseous carrier medium are not shown in the drawing. The controls of the apparatus can be designed in such a way that, once a regulating valve RV is opened, it remains open for a fixed period of time which suffices to ensure that the respective hopper H receives a predetermined quantity of tobacco shreds 9. Alternatively, the duration of tobacco transport through a selected pipe 3 can depend solely on the quantity of tobacco in the respective hopper H, i.e., the transport is interrupted only when the hopper H is refilled to a preselected level.

In the apparatus of FIGS. 3 and 4, the means for converting the supply of tobacco shreds 109 in the storage reservoir 101 into a fluidized bed 106 comprises a unit 138 which causes a plurality of streamlets 143 of a gaseous fluid, preferably compressed air, to flow upwardly through the apertures of the foraminous sieve-like bottom wall 139 of the reservoir. The unit 138 includes a plenum chamber 141 below the foraminous bottom wall 139, conduit means 142 which admits a stream of compressed gas into the plenum chamber 141, and a pump, blower or another device 142a for admitting compressed fluid into the intake end of the conduit means 142. The streamlets 143 which rise through the apertures of the bottom wall 139 entrain the shreds 109 and convert the supply of shreds in the reservoir 101 into the aforementioned fluidized bed or layer 106.

The apparatus of FIGS. 3 and 4 further comprises means for pulsating the stream of air which flows through the conduit means 142 on its way into the plenum chamber 141. Such pulsating means comprises a reciprocable valve plate 146 which is movable into and from a position of overlap with the discharge end of the conduit means 142 by a crank unit 144 shown in FIG. 4. The just described pulsating means further enhances the ability of the streamlets 143 to convert the mass of tobacco shreds 109 in the storage reservoir 101 into a uniform fluidized bed 106 wherein the larger, medium-sized and smaller shreds are uniformly distributed and which regenerates itself in a fully automatic way by supplying shreds to the region or regions where the intakes (not specifically designated) of the conveying pipes 103 draw shreds from the reservoir. The manner in which the upper side of the bed 106 in the reservoir 101 is monitored and the manner in which the conveyor 102 is driven, when necessary, to ensure that the quantity of tobacco shreds 109 in the reservoir 101 remains substantially constant, is preferably the same as described in connection with FIGS. 1 and 2.

FIG 5 illustrates a portion of a further apparatus wherein all such parts which are identical with or clearly analogous to corresponding parts of the apparatus of FIGS. 1 and 2 are denoted by similar reference characters plus 200. This apparatus combines the features of the apparatus of FIGS. 1–2 and 3–4, i.e., it comprises a drive 211 for mechanically agitating the storage reservoir 201 as well as a unit 238 which causes streamlets 243 of a compressed gaseous fluid to rise through the apertures of the foraminous sieve-like bottom wall 239 of the reservoir. The plenum chamber 241 is stationary and is adjacent to the underside of the bottom wall 239. Suitable sliding seals 241a are provided to prevent escape of any compressed gas (or to limit such escape) in the region where the bottom wall 239 moves relative to the housing of the chamber 241. The drive 211 may but need not be identical with the drive 11 of FIGS. 1 and 2. The same holds true for the units 138 and 238; for example, the unit 238 need not embody an equivalent of the reciprocable gate 146. The reference characters 202, 203, 206, 209 and 242 respectively denote the feeding conveyor, the pneumatic conveying pipes, the fluidized bed, the shreds and the conduit means of the pulsating means.

FIG. 6 shows a portion of a modified storage reservoir 301 which has a substantially semicircular cross-sectional outline. The conveying pipes 303 are adjacent to the concave side of the concavo-convex side wall 301*a* of the reservoir 301, and the discharge end of the conveyor 302 feeds tobacco shreds into a portion of the reservoir which is adjacent to the straight side wall 302*b*. The neigboring pipes 303 are preferably equidistant from each other and all pipes 303 are preferably equidistant from the discharge end of the feeding conveyor 302.

In the apparatus of FIGS. 7 and 8, the storage reservoir 401 is an upright cylinder having a cylindrical peripheral wall 401*a*. The pipes 403 are adjacent to the inner side of the wall 401*a* and are equidistant from the discharge end of the conveyor 402 which feeds tobacco shreds into the central portion of the interior of the reservoir 401. The neighboring pipes 403, and more particularly the intakes of neighboring pipes 403, are preferably equidistant from each other.

As shown in FIG. 8, the bottom wall 439 of the reservoir 401 has a raised portion below the discharge end of the feeding conveyor 402 and this bottom wall slopes downwardly toward the lower end of the peripheral wall 401*a*. The slope or inclination of the outer part of the bottom wall 439 is preferably slight. A similar construction or design of the bottom wall is possible and often advisable in the embodiment of FIG. 6, i.e., the bottom wall 339 can have a raised portion below the discharge end of the conveyor 302 and a downwardly sloping part which extends from the raised portion toward the lower end of the hollow semicylindrical wall 301*a*.

The apparatus which is illustrated in FIG. 9 embodies certain features of the apparatus of FIGS. 1–2, 3–4, 5 and 7–8. The main difference between this apparatus and the previously illustrated and described apparatus is that the vertical intakes of conveying pipes 503 are disposed in the central portion of the cylindrical or substantially cylindrical storage reservoir 501. The reservoir 501 is agitated mechanically by a drive 511 and its contents are agitated pneumatically by a unit 538 which is identical with or analogous to the unit 138 or 238. The foraminous bottom wall 539 of the reservoir 501 allows streamlets 543 of compressed gaseous fluid (normally air) to rise into the lower part of the reservoir 501 and to thus assist the mechanical unit 511 in converting the entire or nearly entire contents (shreds 509 supplied by conveyor 502) of the reservoir into a fluidized bed 506. The supply of shreds 509 in the reservoir 501 is replenished, when necessary, by the conveyor 502 whose discharge end is adjacent to the cylindrical peripheral wall 501*a* of the reservoir. The arrows 537 denote the direction of flow of air and tobacco shreds 509 into selected pipes 503. As explained in connection with FIGS. 1 and 2, the currents of air flowing into one or more selected pipes 503 are drawn from the region between the bottom wall 539 and the underside of the floating fluidized bed or layer 506, and the intakes of the selected pipes 503 draw tobacco shreds 509 directly from the bed 506.

It is clear that, in each of the heretofore described embodiments, the number of tobacco conveying pipes can be reduced below sixteen or increased to seventeen or more. Also, each apparatus can have two or more feeding conveyors which can be operated simultaneously or one after the other. For example, the apparatus of FIG. 9 can be provided with two conveyors 502 which are located diametrically opposite each other.

Figure 11:
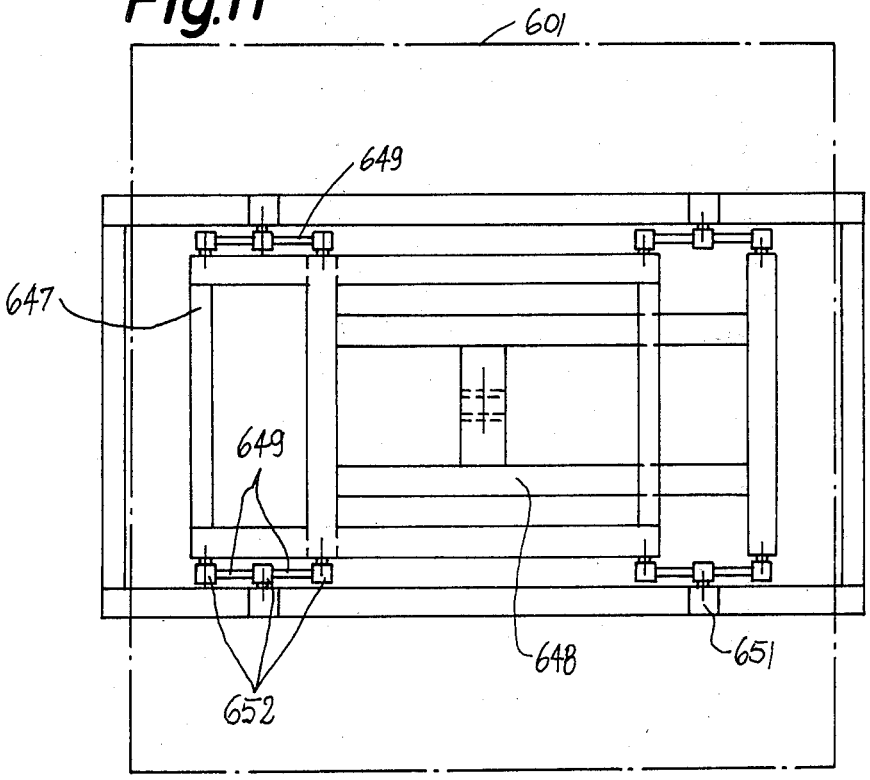
FIG. 11 is a schematic plan view of the structure which is shown in FIG. 10.

FIGS. 10 and 11 show a modified oscillating or agitating drive 611 for a trough-shaped storage reservoir 611 which serves the same purpose as the aforedescribed reservoir 1, 101, 201, 301, 401 or 501. The reservoir 601 is mounted on a frame 647 which, in turn, is mounted on a stationary support or base 651 by means of parallel links 649. Similar or identical links 649 are used to mount a counterweight 648 on the base 651. In the illustrated embodiment, each link 649 has a first end portion which is articulately connected with the oscillating frame 647 for the storage reservoir 601, a second end portion which is articulately connected with the counterweight 648, and a median portion which is articulately connected with the base 651. The connecting means for the central portions and end portions of the links 649 comprises elastic elements 652 which enable the frame 647 and the counterweight 648 to move relative to the base 651. The elements 652 may consist of rubber or other suitable elastomeric material. The means for imparting reciprocatory or oscillating movements to the counterweight 648 and frame 647 comprises a simple crank drive 653 which is mounted on the base 651 and whose output element is coupled to the counterweight 648.

Figure 12:
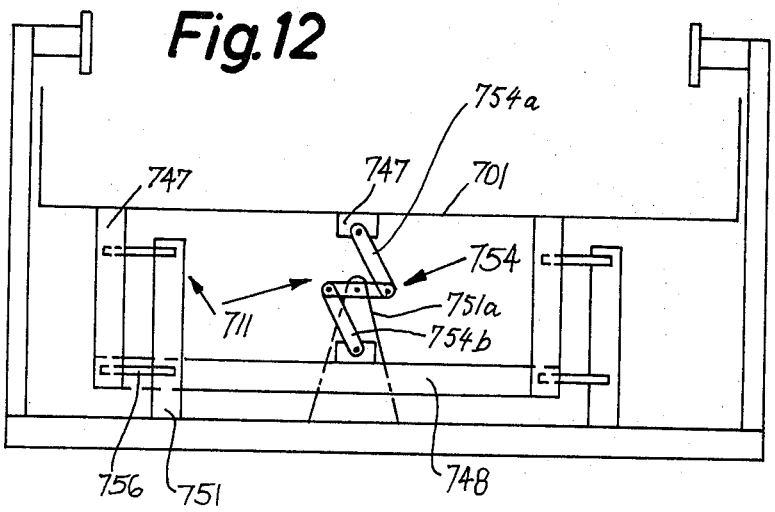
FIG. 12 is a schematic partly side elevational and partly longitudinal vertical sectional view of an apparatus wherein the mechanical drive for the reservoir constitutes a modification of the drive shown in FIGS. 10 and 11.
Figure 13:
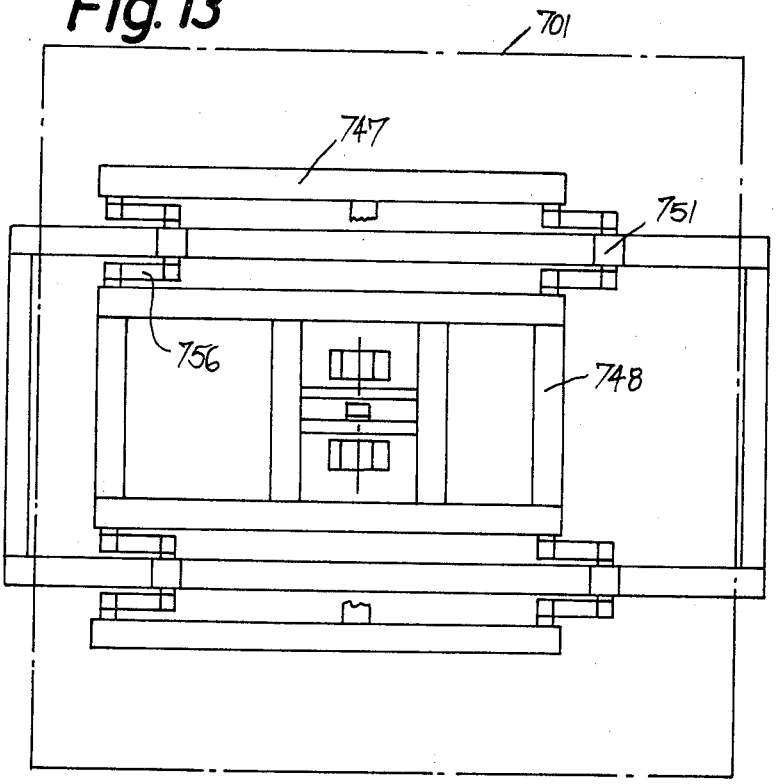
FIG. 13 is a schematic plan view of the structure which is shown in FIG. 12.

FIGS. 12 and 13 illustrate a modification of the structure of FIGS. 10 and 11. The crank drive 653 of FIG. 10 is replaced with a twin crank drive 754 which forms part of the drive means 711 for the storage reservoir 701. The output element 754*a* of the drive 754 is articulately connected with the frame 747 for the reservoir 701, and the other output element 745*b* of the drive 754 is articulately connected with the counterweight 748. The median portion of the drive 754 is mounted on an upright column 751*a* of the support or base 751. The reference characters 756 denote links in the form of leaf springs which connect the frame 747 and the counterweight 748 with the support 751. These leaf springs replace or are used in addition to the elastic elements 652 of FIGS. 10 and 11.

Figure 14:
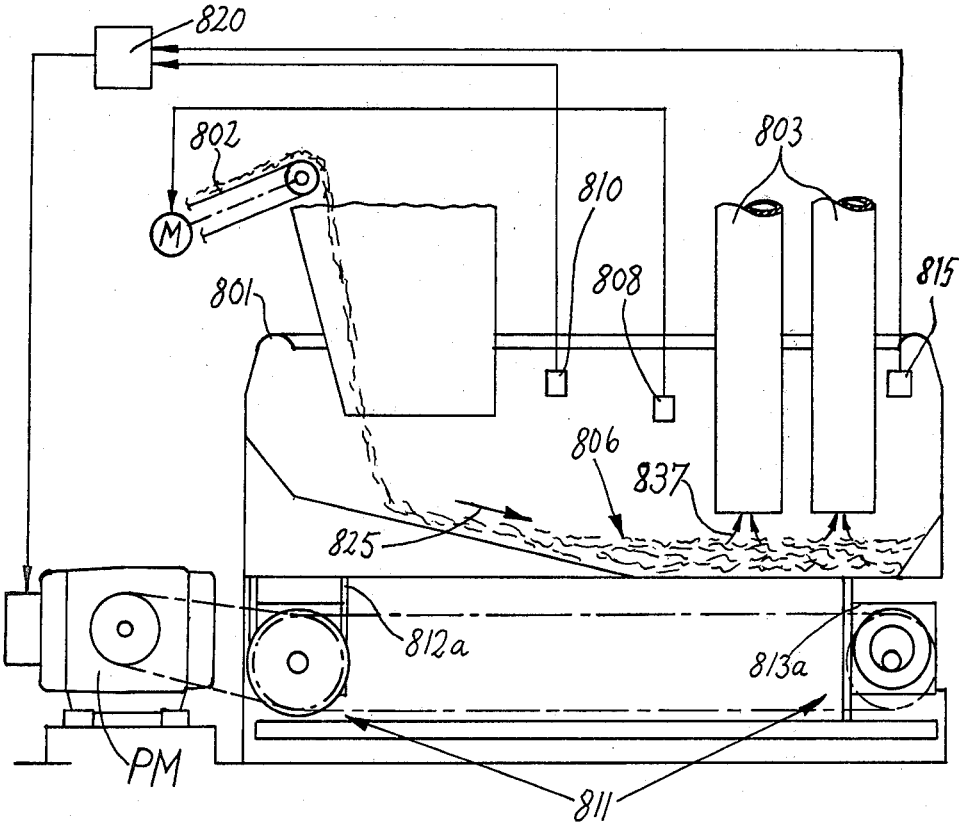
FIG. 14 illustrates a modification of the apparatus which is illustrated in FIGS. 1 and 2.

The apparatus of FIG. 14 is similar to that of FIGS. 1 and 2. Therefore, the parts which are analogous to or identical with those shown in FIGS. 1 and 2 are denoted by similar reference characters plus 800. The direction in which the particles of tobacco advance through the reservoir 801 (i.e., from the feeding device 802 toward the pipes 803) under the action of the agitating means 811 is indicated by an arrow 825. The upstream and downstream ends of the reservoir 801 (as viewed in the direction of the arrow 825) are respectively adjacent to signal generating monitoring devices 810 and 815 in the form of photocells or analogous light-sensitive detectors. These detectors are respectively located ahead of and behind the pipes 803. If desired, the photocells 810 and 815 can be replaced by capacitive limit switches or the like. The monitoring devices 810 and 815 are directed toward discrete portions of the upper surface of the fluidized bed 806 in the reservoir 801 and are connected with a control means 820 of known design which, in turn, is connected with the prime mover PM for the variable-frequency agitating means 811. When the monitoring device 810 detects a rise in the level of tobacco particles in the respective portion of the fluidized bed 806 or a pile-up of particles in the respective portion of the reservoir 801, it transmits a signal to the control means 820 which automatically increases the RPM of the prime mover PM and hence the frequency of the agitating means 811. However, if the monitoring device 815 detects a rise in the level of tobacco particles in the corresponding portion of the fluidized bed 806 or an accumulation of tobacco particles in the respective portion of the reservoir 801 (behind the pipes 803), it transmits a signal to the control means 820 in order to cause the latter to automatically reduce the RPM of the prime mover PM and to thus reduce the frequency of the agitating means 811. Thus, in each instance, the control means 820 cooperates with the monitoring device 810 or 815 to bring about an equalization of the upper level and hence a stabilization of the fluidized bed 806.

Control means which can be used in the apparatus of FIG. 14 to increase or reduce the RPM of a prime mover and hence the frequency of agitating means which is driven by the prime mover in response to signals which are generated by two discrete level monitoring devices is disclosed, for example, in U.S. Pat. No. 4,037,712 granted July 26, 1977 to Wochnowski.

An important advantage of the improved apparatus is that the major part of the supply of tobacco particles in the storage reservoir invariably floats above the bottom wall, i.e., that the major part of such supply constitutes a fluidized bed wherein the particles are uniformly mixed and do not tend to adhere to each other. On the contrary, the conversion of a stream which is delivered by the feeding conveyor (such as the conveyor 2 of FIG. 1) into a fluidized layer or bed invariably entails at least some loosening and disentangling of tobacco particles, especially if the particles are shreds. The uniform mixture of larger, smaller and medium-sized particles which form the fluidized bed can be readily entrained toward a selected consuming or processing machine even if the speed of the air stream in a conveying pipe is relatively low. As explained above, the intake of a selected conveying pipe draws air from the region below the fluidized bed and the ascending current of air first propels and thereupon automatically draws tobacco particles directly from the fluidized bed. The aforedescribed tendency of the fluidized bed to regenerate itself, i.e., to fill in the void or voids which develop therein as a result of entrainment of tobacco particles via one or more selected conveying pipes, is highly desirable and advantageous because it further reduces the likelihood of undue accumulation of and clumping or interlacing of tobacco shreds in certain regions of the storage reservoir. Moreover, there is no need to return surplus tobacco from the hopper or hoppers H of the consuming machine or machines; this is also desirable since the transport of tobacco shreds invariably results in the formation of so-called shorts and/or tobacco dust, i.e., of fragments whose dimensions are too small and, therefore, are not suited for the making of a satisfactory rod-like tobacco filler which is thereupon wrapped into cigarette paper or the like and severed to yield plain cigarettes, cigars or cigarillos of desired length.

Upward transport of tobacco shreds from the fluidized bed (i.e., such orientation of the lower portions of conveying pipes that the particles of tobacco travel vertically upwardly, at least in the region immediately above the upper side of the fluidized bed) has been found to be especially desirable and advantageous for several reasons. Thus, the intakes of several pipes can be placed close to each other and the rate of flow of compressed gas (air) into and through the pipes is quite satisfactory.

A further important advantage of the improved apparatus is its compactness and its ability to supply comminuted tobacco to a large number of consuming machines, either simultaneously or seriatim. Furthermore, and since the connections between the storage reservoir and the discrete consuming machines are extremely simple (each such connection merely comprises a pipe), the improved apparatus can be readily attached to or combined with any presently known consuming machines whereby such consuming machines may but need not be of the same vintage, type and/or size.

An additional advantage of the improved apparatus is its low maintenance cost. Clogging of various pipes and/or excessive drying of tobacco shreds in the reservoir can be avoided in a very efficient manner by the simple expedient of evacuating the contents of the storage reservoir before the apparatus is brought to a stop, i.e., the contents of the reservoir are preferably transferred into the hoppers H of the consuming machines CRMM before the apparatus and the consuming machines are brought to a halt.

Still another advantage of the improved apparatus is that its storage reservoir can receive comminuted tobacco from any conventional major source, e.g., directly from one or more shredding machines or directly from a rotary drum which conditions the shreds by uniformizing their moisture content prior to introduction into the reservoir. The belt conveyor or conveyors which are shown in the drawing can be replaced by or used simultaneously with pneumatic means for delivering tobacco shreds into the reservoir. Other means which can supply tobacco shreds to the reservoir include customary bulking chutes or conveyor means for drawing tobacco shreds directly from a silo.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for supplying comminuted tobacco or similar particulate material to several consuming machines, especially for supplying shredded tobacco to a plurality of cigarette rod making machines, comprising a storage reservoir; means for feeding comminuted tobacco into said reservoir; means for converting at least the major part of tobacco in said reservoir into a fluidized bed, including means for imparting substantially vertical up-and-down movements to comminuted tobacco in said reservoir; means for pneumatically conveying comminuted tobacco directly from the fluidized bed to selected consuming machines; and means for monitoring the quantity of tobacco in said reservoir, including means for starting said feeding means when the quantity of tobacco in said reservoir drops below a predetermined value.

2. The apparatus of claim 1, wherein said reservoir includes a bottom wall and said conveying means comprises a discrete pipe for each of the consuming machines, said pipes having intakes extending into said reservoir and being spaced apart from said bottom wall.

3. The apparatus of claim 2, wherein said reservoir comprises a foraminous bottom wall and said converting means comprises a plenum chamber disposed below said bottom wall and means for supplying a compressed fluid into said chamber so that the gas which escapes from said chamber via said bottom wall causes the comminuted tobacco in said reservoir to float and to form said fluidized bed.

4. The apparatus of claim 3, wherein said converting means further comprises means for pulsating the gas which enters said reservoir via said bottom wall.

5. The apparatus of claim 4, wherein said means for supplying compressed gaseous fluid comprises conduit means having a discharge end connected with said chamber and said pulsating means comprises means for intermittently sealing and unsealing said conduit means.

6. The apparatus of claim 2, wherein said converting means comprises means for mechanically agitating and means for pneumatically agitating comminuted tobacco in said reservoir.

7. The apparatus of claim 6, wherein said reservoir has a foraminous bottom wall and said means for pneumatically agitating comprises a plenum chamber below said bottom wall and means for supplying a compressed gas into said chamber so that the gas which leaves said chamber to enter said reservoir through said bottom wall forms a plurality of ascending streamlets which lift comminuted tobacco off said bottom wall and cause the lifted tobacco to float in said reservoir.

8. The apparatus of claim 2, wherein said reservoir has a substantially semicircular cross-sectional outline.

9. The apparatus of claim 8, wherein said intakes are substantially equidistant from said discharge end.

10. The apparatus of claim 8, wherein said intakes include a plurality of equidistant neighboring intakes.

11. The apparatus of claim 2, wherein said reservoir has a substantially circular cross-sectional outline and includes a cylindrical side wall, said intakes being adjacent to said side wall and said feeding means including a portion which discharges comminuted tobacco into the center of said reservoir.

12. The apparatus of claim 11, wherein said intakes are substantially equidistant from said portion of said feeding means.

13. The apparatus of claim 2, wherein said reservoir has a substantially circular cross-sectional outline and includes a cylindrical side wall, said intakes being disposed at the center of said reservoir and said feeding means including a portion which discharges comminuted tobacco into said reservoir in a region adjacent to said side wall.

14. The apparatus of claim 13, wherein said converting means further comprises means for pneumatically agitating comminuted tobacco in said reservoir, said reservoir having a foraminous bottom wall and said means for pneumatically agitating including means for conveying currents of a gaseous fluid through said bottom wall and into the interior of said reservoir.

15. The apparatus of claim 2, wherein said reservoir has a substantially polygonal cross-sectional outline and includes a plurality of upstanding walls, said intakes being adjacent to one of said walls and said feeding means including a portion which discharges comminuted tobacco into said reservoir adjacent to another of said walls.

16. The apparatus of claim 2, wherein said intakes are disposed in several groups of four intakes each.

17. The apparatus of claim 2, wherein said intakes are disposed in a plurality of rows.

18. The apparatus of claim 2, wherein said fluidized bed has an upper side facing away from and spaced apart from said bottom wall, said intakes having open lower ends adjacent to said upper side.

19. The apparatus of claim 2, further comprising means for reducing the pressure in selected pipes so as to draw comminuted tobacco into such selected pipes by suction.

20. The apparatus of claim 2, wherein said intakes are substantially vertical.

21. The apparatus of claim 2, wherein said intakes are hollow frusta of cones and taper upwardly and away from said bottom wall.

22. The apparatus of claim 2, wherein said means for imparting up-and-down movements comprises mechanical oscillating means for said storage reservoir.

23. The apparatus of claim 22, wherein said oscillating means comprises at least one rotary eccentric, means for rotating said eccentric, and means for moving said reservoir up and down in response to rotation of said eccentric.

24. The apparatus of claim 23, wherein said reservoir includes a bottom wall and said moving means acts directly upon said bottom wall.

25. The apparatus of claim 24, wherein said eccentric constitutes a support on which said reservoir rests and said eccentric is rotatable about a substantially horizontal axis.

26. The apparatus of claim 22, wherein said oscillating means includes a stationary support, a plurality of substantially parallel links articulately connecting said support with said reservoir, and means for moving said reservoir with respect to said support.

27. The apparatus of claim 26, wherein said moving means comprises a crank drive.

28. The apparatus of claim 26, further comprising at least one counterweight movable by and articulately connected with said links.

29. The apparatus of claim 28, wherein said moving means includes a twin crank drive.

30. The apparatus of claim 29, wherein said crank drive has a first output element articulately connected with said reservoir and a second output element articulately connected with said counterweight.

31. The apparatus of claim 1, wherein said fluidized bed has an upper surface and further comprising means for equalizing the upper surface of said bed.

32. The apparatus of claim 31, wherein said equalizing means comprises signal generating means for monitoring the level of the upper surface of the fluidized bed in at least one portion of said reservoir.

33. The apparatus of claim 1, wherein said monitoring means includes means for monitoring the level of the upper surface of the fluidized bed in said reservoir.

34. The apparatus of claim 33, wherein said means for monitoring the level of the upper surface of the fluidized bed comprises a reflection type photocell.

35. Apparatus for supplying comminuted tobacco or similar particular material to several consuming machines, especially for supplying shredded tobacco to a plurality of cigarette rod making machines, comprising a storage reservoir having a bottom wall; means for feeding comminuted tobacco into said reservoir; means for converting at least the major part of tobacco in said reservoir into a fluidized bed, comprising mechanical oscillating means for said reservoir, said oscillating means comprising a stationary support, a plurality of substantially parallel links including resilient means and articulately connecting said support with said reservoir, and means for moving said reservoir with respect to said support; at least one counterweight movable by and articulately connected with said links, said moving means including a twin crank drive having a first output element articulately connected with said reservoir and a second output element articulately connected with said counterweight; and means for pneumatically conveying comminuted tobacco directly from the fluidized bed to selected consuming machines, including a discrete pipe for each of the consuming machines, said pipes having intakes extending into said reservoir and being spaced apart from said bottom wall.

36. The apparatus of claim 35, wherein said resilient means are leaf springs.

37. Apparatus for supplying comminuted tobacco or similar particulate material to several consuming machines, especially for supplying shredded tobacco to a plurality of cigarette rod making machines, comprising a storage reservoir having a substantially semicircular cross-sectional outline and including a bottom wall, a substantially semicylindrical first side wall having a convex outer side and a concave inner side and a substantially flat second side wall; means for feeding comminuted tobacco into said reservoir; means for converting at least the major part of tobacco in said reservoir into a fluidized bed; and means for pneumatically conveying comminuted tobacco directly from the fluidized bed to selected consuming machines, including a discrete pipe for each of the consuming machines, said pipes having intakes extending into said reservoir and being spaced apart from said bottom wall, said intakes being adjacent to the inner side of said first side wall and said feeding means having a discharge end adjacent to said second side wall.

38. Apparatus for supplying comminuted tobacco or similar particulate material to several consuming machines, especially for supplying shredded tobacco to a plurality of cigarette rod making machines, comprising a storage reservoir; means for feeding comminuted tobacco into said reservoir; means for converting at least the major part of tobacco in said reservoir into a fluidized bed having an upper surface, including means for agitating said reservoir at a variable frequency; means for equalizing the upper surface of the fluidized bed, including signal generating means for monitoring the level of the upper surface of the fluidized bed in at least one portion of said reservoir and control means for varying said frequency in response to signals from said monitoring means; and means for pneumatically conveying comminuted tobacco directly from the fluidized bed to selected consuming machines.

39. The apparatus of claim 38, wherein said agitating means is operative to advance comminuted tobacco of said fluidized bed in a direction from said feeding means toward said conveying means and said monitoring means comprises a first and a second monitoring device for discrete portions of the upper surface of said bed, one of said monitoring device being located upstream of the other of said monitoring devices, as considered in said direction.

40. The apparatus of claim 39, wherein said control means is operative to increase said frequency in response to signals generated by said one monitoring device and denoting a rise in the level of the respective portion of said upper surface.

41. The apparatus of claim 39, wherein said control means is operative to reduce said frequency in response to signals generated by said other monitoring device and denoting a rise in the level of the respective portion of said upper surface.

42. Apparatus for supplying comminuted tobacco or similar particulate material to several consuming machines, especially for supplying shredded tobacco to a plurality of cigarette rod making machines, comprising a storage reservoir; means for feeding comminuted tobacco into said reservoir; means for pneumatically conveying comminuted tobacco directly from said reservoir to selected consuming machines, including a plurality of intakes disposed above the comminuted tobacco in said reservoir to draw particles of tobacco from the reservoir; and means for converting at least the major part of tobacco in said reservoir into a fluidized bed, including means for automatically leveling the fluidized bed in said reservoir irrespective of the distribution of said intakes, said leveling means including means for imparting substantially vertical up-and-down movements to comminuted tobacco in said reservoir.

* * * * *